US010597921B2

(12) United States Patent
Alban

(10) Patent No.: US 10,597,921 B2
(45) Date of Patent: Mar. 24, 2020

(54) ACTUATING DEVICE FOR THE SASH OF A SLIDING WINDOW OR DOOR

(71) Applicant: ALBAN GIACOMO S.P.A., Romano d'Ezzelino (Vicenza) (IT)

(72) Inventor: Giacomo Mario Alban, Bassano del Grappa (IT)

(73) Assignee: Alban Giacomo S.p.A, Romano d'Ezzelino (Vicenza) (IT)

( * ) Notice: Subject to any disclaimer, the term of this patent is extended or adjusted under 35 U.S.C. 154(b) by 0 days.

(21) Appl. No.: 16/085,326

(22) PCT Filed: Feb. 9, 2017

(86) PCT No.: PCT/IB2017/050706
§ 371 (c)(1),
(2) Date: Sep. 14, 2018

(87) PCT Pub. No.: WO2017/158448
PCT Pub. Date: Sep. 21, 2017

(65) Prior Publication Data

US 2019/0071910 A1 Mar. 7, 2019

(30) Foreign Application Priority Data

Mar. 14, 2016 (IT) ..... 102016000026617

(51) Int. Cl.
*E05D 15/56* (2006.01)
*E05D 15/06* (2006.01)

(52) U.S. Cl.
CPC ..... *E05D 15/565* (2013.01); *E05D 15/066* (2013.01); *E05D 15/0665* (2013.01);
(Continued)

(58) Field of Classification Search
CPC . E05D 15/565; E05D 15/066; E05D 15/0665; E05D 15/0669; Y10T 16/3816;
(Continued)

(56) References Cited

U.S. PATENT DOCUMENTS 257,401 A * 5/1882 Somers ..... E05D 15/0669 16/100
1,370,037 A * 3/1921 Morin ..... E05D 15/0634 16/104
(Continued)

FOREIGN PATENT DOCUMENTS

EP 1582677 A1 10/2005
EP 1970514 A2 9/2008
(Continued)

OTHER PUBLICATIONS

International Search Report for Application No. PCT/IB2017/050706 dated May 30, 2017 in 3 pages.

*Primary Examiner* — Jeffrey O'Brien
(74) *Attorney, Agent, or Firm* — Knobbe, Martens, Olson & Bear, LLP

(57) ABSTRACT

A sliding window or door includes sash, a frame and an actuator, which includes a carriage. The carriage includes a slide mounted on the sash so as to enable a secondary sliding motion between a stationed position and a sliding position and vice versa. The carriage also a connecting portion fixed to the sash and associated with the slide so that the secondary sliding motion of the slide towards the sliding position determines a raising of the sash and the secondary sliding motion of the slide towards the stationed position determines a lowering of the sash. A rotating actuator is mounted on a rear head surface of the sash, and has a rotation axis parallel to said sliding direction. A rear command shaft is arranged along the rear head surface of the sash and operatively
(Continued)

interposed between the actuator and the carriage for generating the secondary sliding motion.

10 Claims, 9 Drawing Sheets

(52) U.S. Cl.
CPC ..... *E05D 15/0669* (2013.01); *Y10T 16/3816* (2015.01); *Y10T 16/3834* (2015.01)

(58) Field of Classification Search
CPC ..... Y10T 16/3819; Y10T 16/3825; Y10T 16/3828; Y10T 16/3831; Y10T 16/3834
See application file for complete search history.

(56) References Cited

U.S. PATENT DOCUMENTS 3,731,431 A * 5/1973 Banner ..... E05D 15/0669 49/420
5,546,706 A * 8/1996 Coupet ..... E05D 15/0669 16/105
5,791,089 A * 8/1998 Prevot ..... E05D 15/0669 49/425
7,971,392 B2 * 7/2011 Seo ..... E05D 15/565 49/209
8,240,089 B2 * 8/2012 Lambertini ..... E05D 15/565 49/425
8,533,997 B2 * 9/2013 Stoutenborough ..... E05B 5/00 292/336.3
9,458,656 B2 * 10/2016 Mickelson ..... E05D 15/565
2004/0163317 A1 * 8/2004 Reich ..... E05D 15/565 49/209
2007/0271850 A1 * 11/2007 Mickelson ..... E05D 15/565 49/358
2014/0102006 A1 * 4/2014 Mickelson ..... E05D 15/565 49/349
2017/0159325 A1 * 6/2017 Chaffin ..... E05B 13/004
2017/0275916 A1 * 9/2017 Chaffin ..... E05F 11/14

FOREIGN PATENT DOCUMENTS

EP 2202371 A1 6/2010
EP 2535492 A1 12/2012
JP 2015-178699 A 10/2015

* cited by examiner

ACTUATING DEVICE FOR THE SASH OF A SLIDING WINDOW OR DOOR

CROSS-REFERENCE TO RELATED APPLICATIONS

This application is the U.S. National Phase under 35. U.S.C. § 371 of International Application PCT/IB2017/050706, filed Feb. 9, 2017, which claims priority to Italian Patent Application No. 102016000026617, filed Mar. 14, 2016. The disclosures of the above-described applications are hereby incorporated by reference in their entirety.

FIELD OF THE INVENTION

The present invention relates to an actuating device for a sliding window or door.

The present invention further relates to a sash and a sliding window or door.

In particular, the present invention relates to an actuating device and relative sash and window or door which are defined as lift-and-slide, i.e. in which the sash in the closed position is in the lowered position and rests on the lower base of the frame of the door or window, while in order to slide from the closed position to the open position the sash must be raised with respect to the lower base of the frame.

BACKGROUND OF THE INVENTION

In the sector of windows or doors it is known to use sliding windows or doors, in particular for doors or patio-type doors, in which the sash is made using a glass pane, or other transparent material, provided with a frame having both a structural, housing and connecting function of the devices necessary for the sliding of the sash and blocking thereof in a closed position.

A particularly perceived need in the sector of windows or doors is that of increasing the glass surface as much as possible while maintaining the functionality and resistance of standard windows or doors.

To meet this need sashes have been predisposed in which the frame has significantly smaller dimensions with respect to standard windows or doors. Though the dimensions of the frame are reduced, the proposed solutions have a housing in the panel or the frontal and anterior part of the frame for receiving the handle suitable for unblocking the sash and command sliding thereof to open and/or close. Such housing reduces the glazed surface of the sash, thus limiting the effects of the reduction of the dimensions of the frame.

Further, in the known solutions the handle represents an encumbrance projecting from the internal profile of the window or door which prevents total packaging of the sashes, for example in the case of multi-sash windows or doors, and the transport of the pre-assembled sash.

According to the prior art, also known are sliding windows or doors realised according to the teachings of documents EP1582677, EP2535492 and EP2202371.

SUMMARY OF THE INVENTION

In this context, the technical task underpinning the present invention is to provide an actuating device for a sliding window or door which obviates at least some of the drawbacks in the prior art as described above.

In particular, an aim of the present invention is to make available an actuating device for a sliding window or door sash that is able to increase the glazed surface of a sliding window or door while maintaining the functions of a standard window or door.

A further aim of the present invention is to make available an actuating device for a sliding window or door enabling total packaging of the sash in particular in a case of multi-sash windows or doors and transport of the pre-assembled sash.

The set technical task and the specified aims are substantially attained by an actuating device for sliding window or door, comprising the technical characteristics as set out in one or more of the accompanying claims. The defined technical task and the specified aims are substantially achieved by a sash for a sliding window or door and a sliding window or door comprising the technical characteristics set out in one or more of the appended claims.

The dependent claims correspond to different possible embodiments of the invention.

Further characteristics and advantages of the present invention will appear more clearly from the indicative and therefore non-limiting description of a preferred, but not exclusive, embodiment of an actuating device for a sash of a sliding window or door, of a sash for a sliding window or door, and a relative sliding window or door.

BRIEF DESCRIPTION OF THE DRAWINGS

The description will be set out below with reference to the attached drawings, provided solely for indicative and therefore non-limiting purposes, in which.

Figure 1:
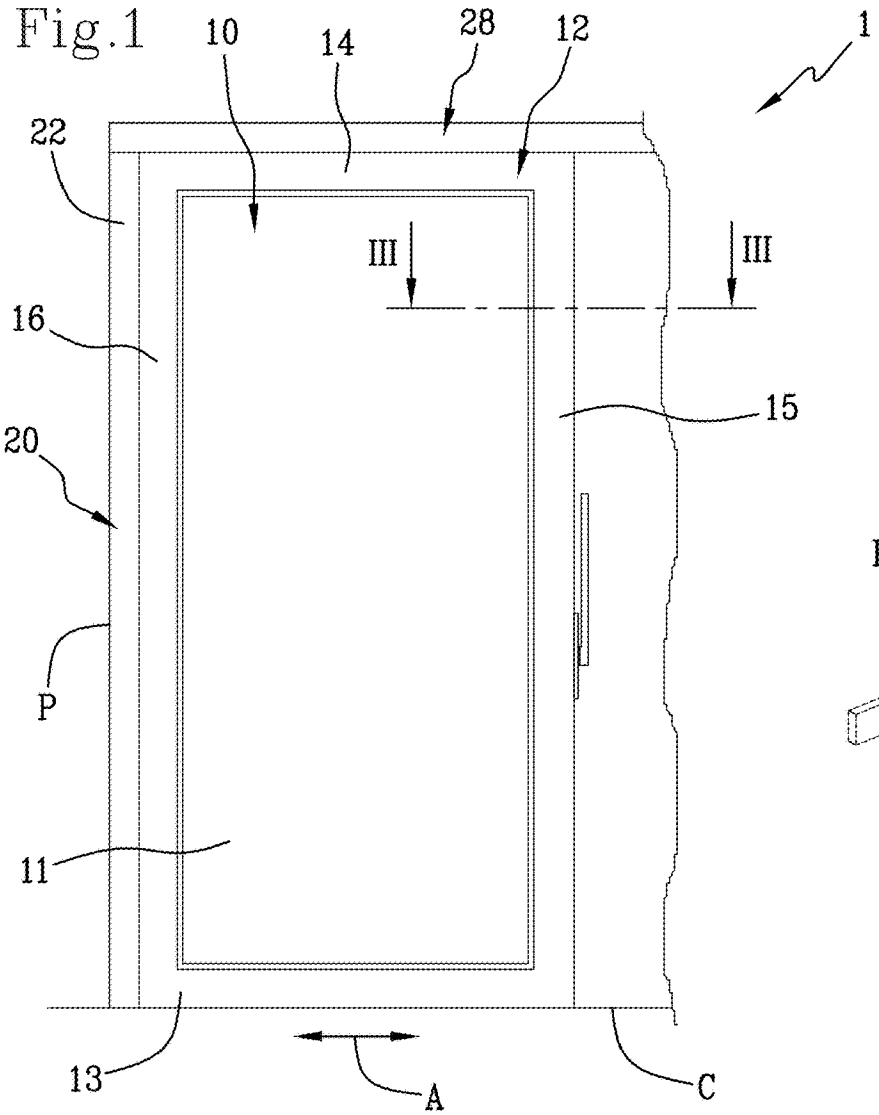
FIG. 1 is a schematic front view of a sliding window or door according to the present invention.
Figure 5:
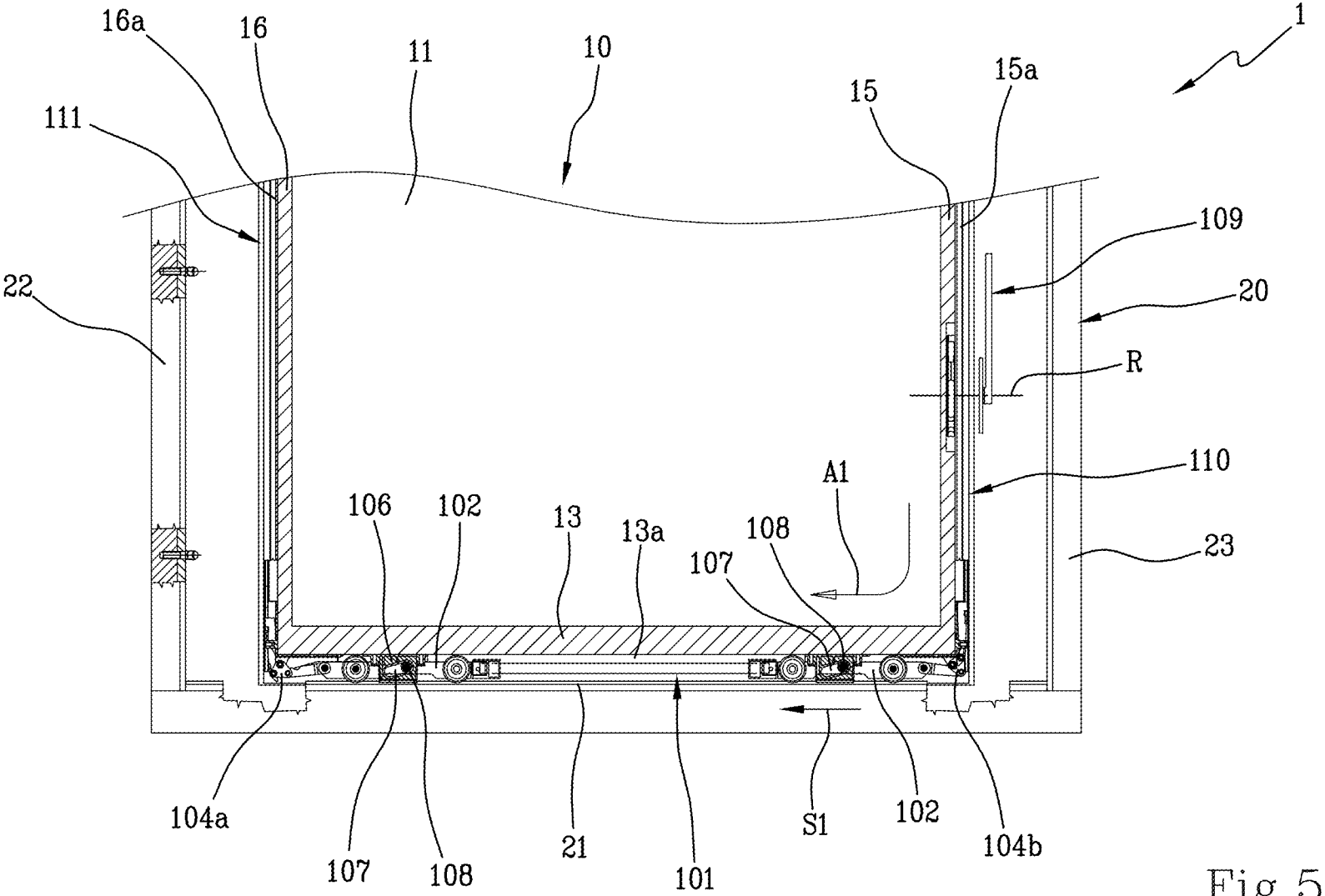
Figure 6:
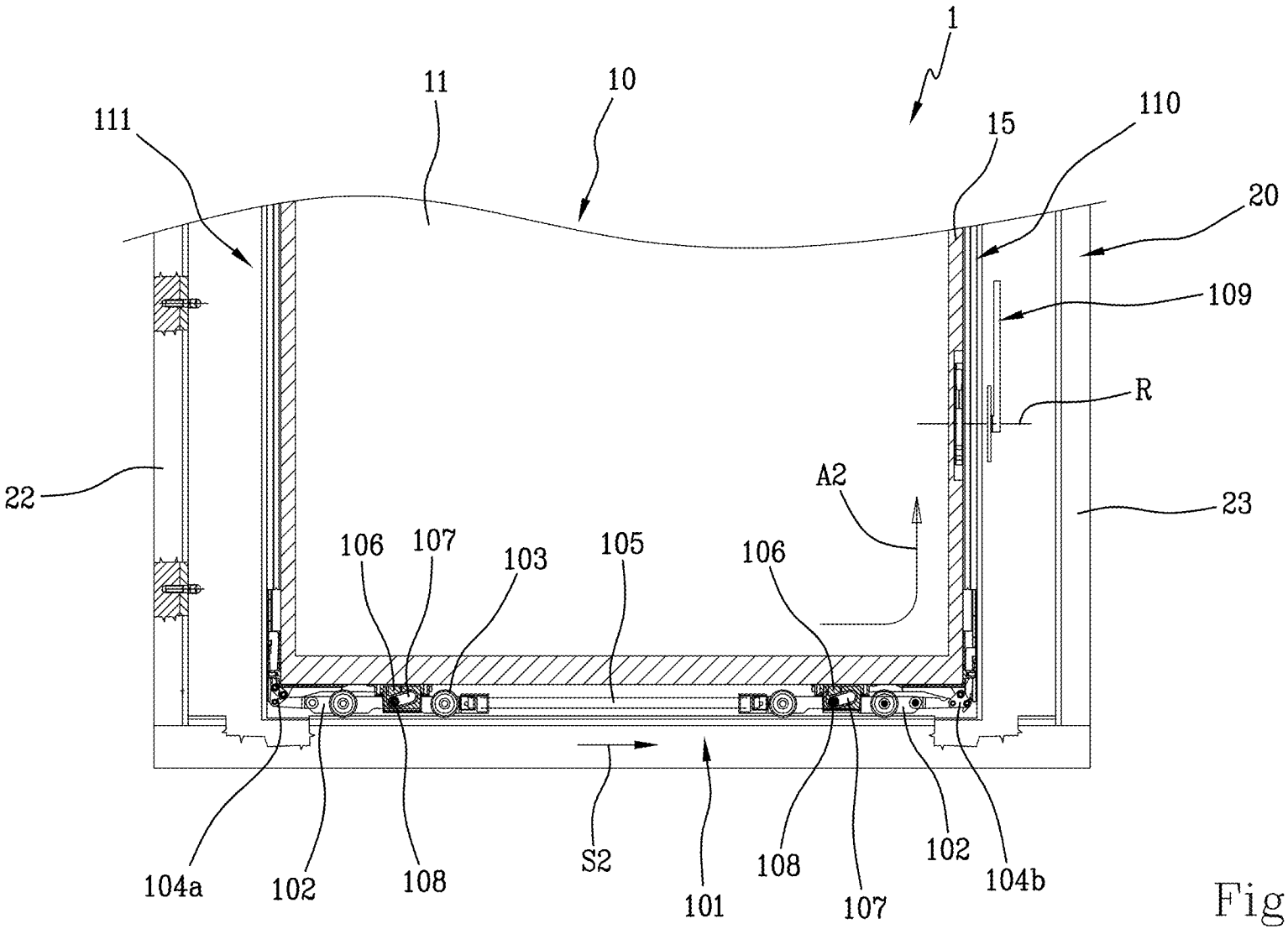
Figure 7:
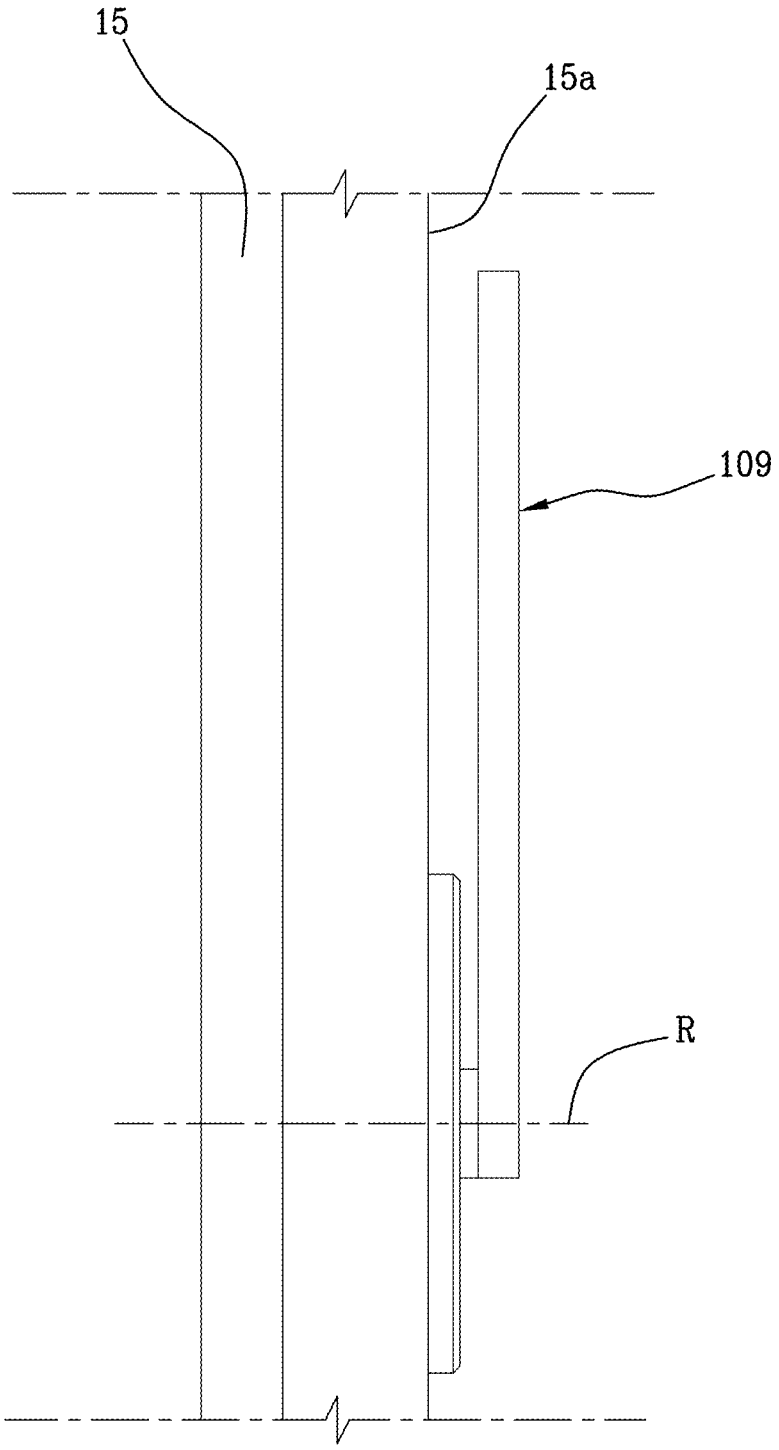
Figure 8:
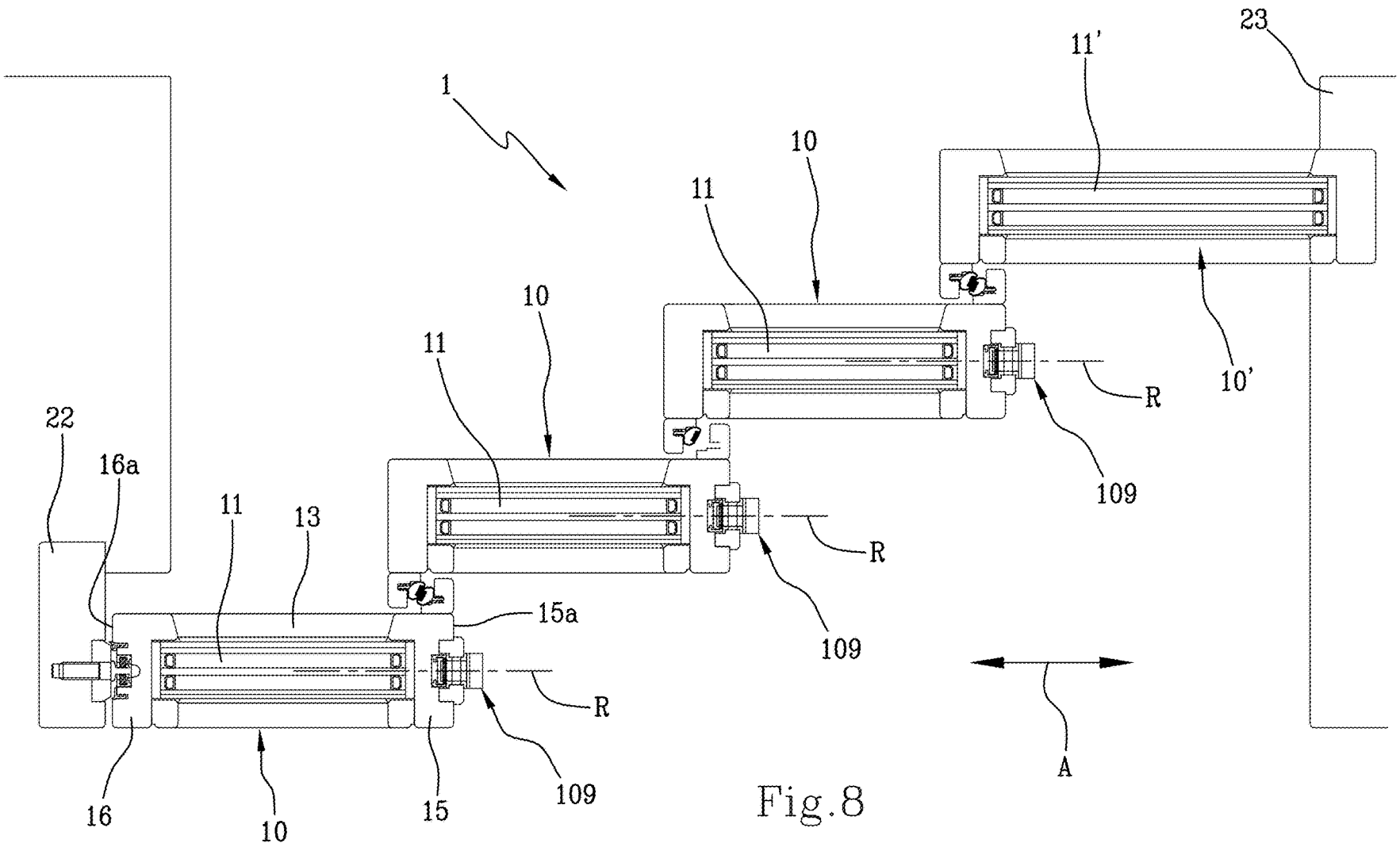
Figure 9:
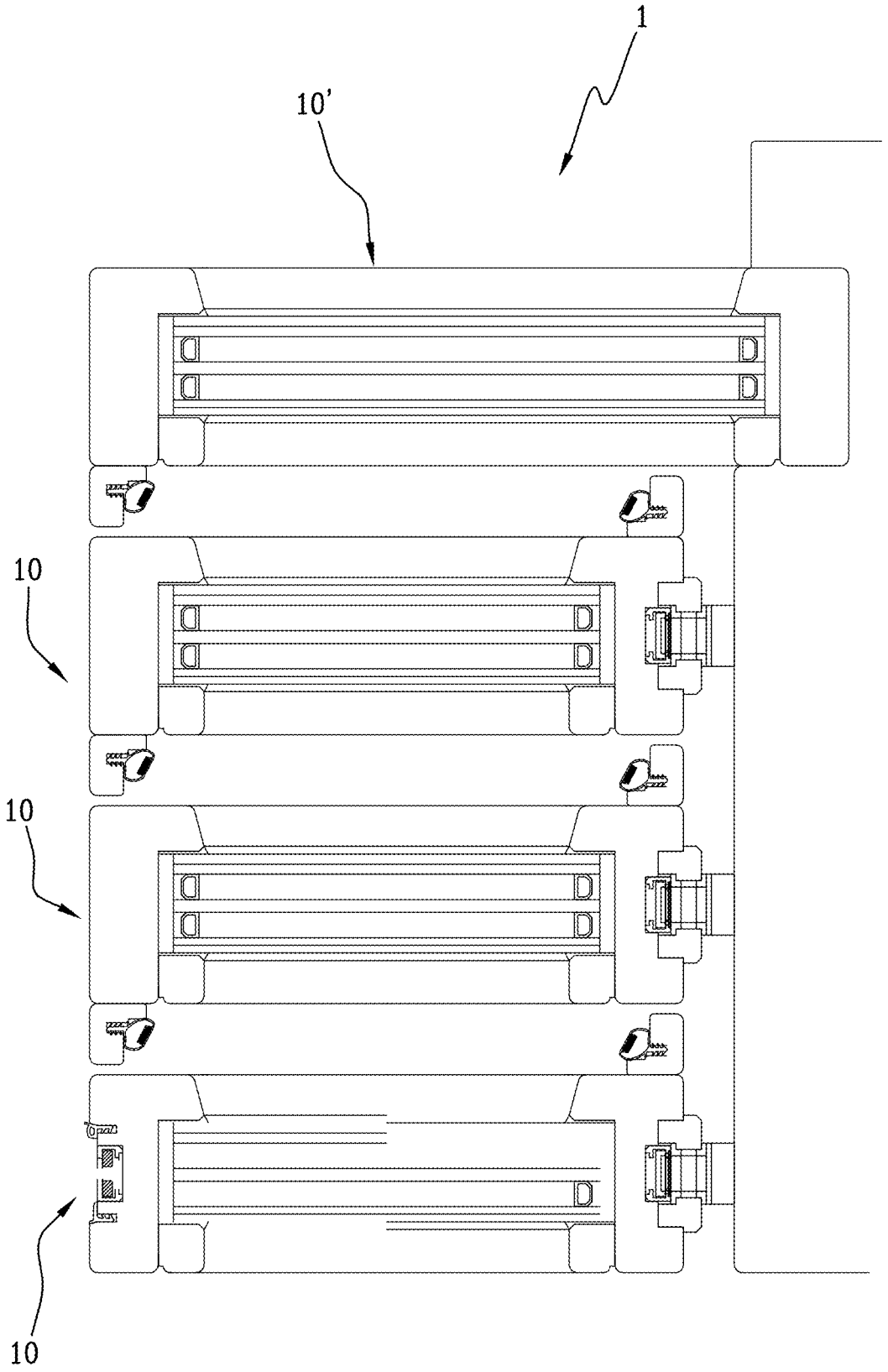
Figure 10:
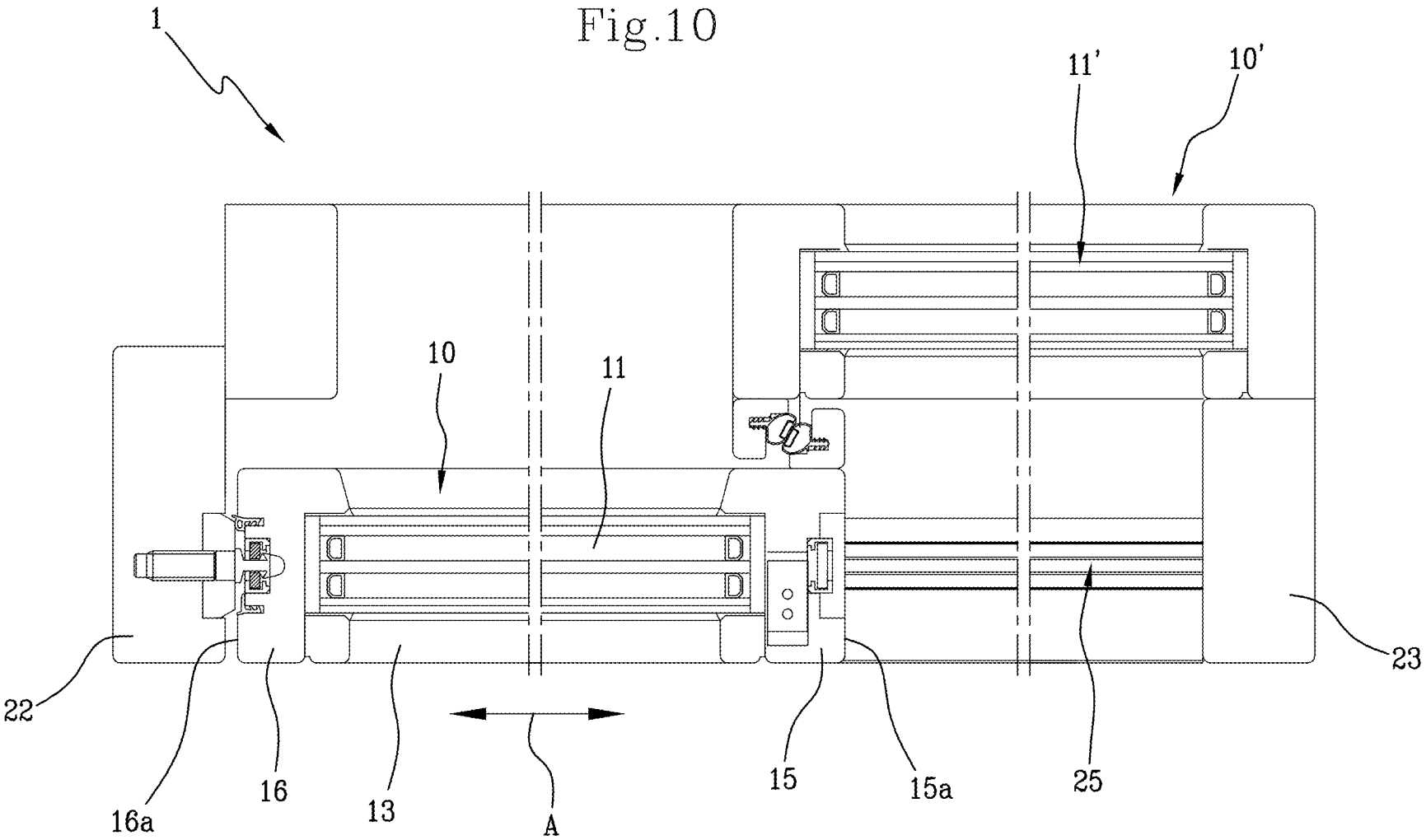
Figure 11:
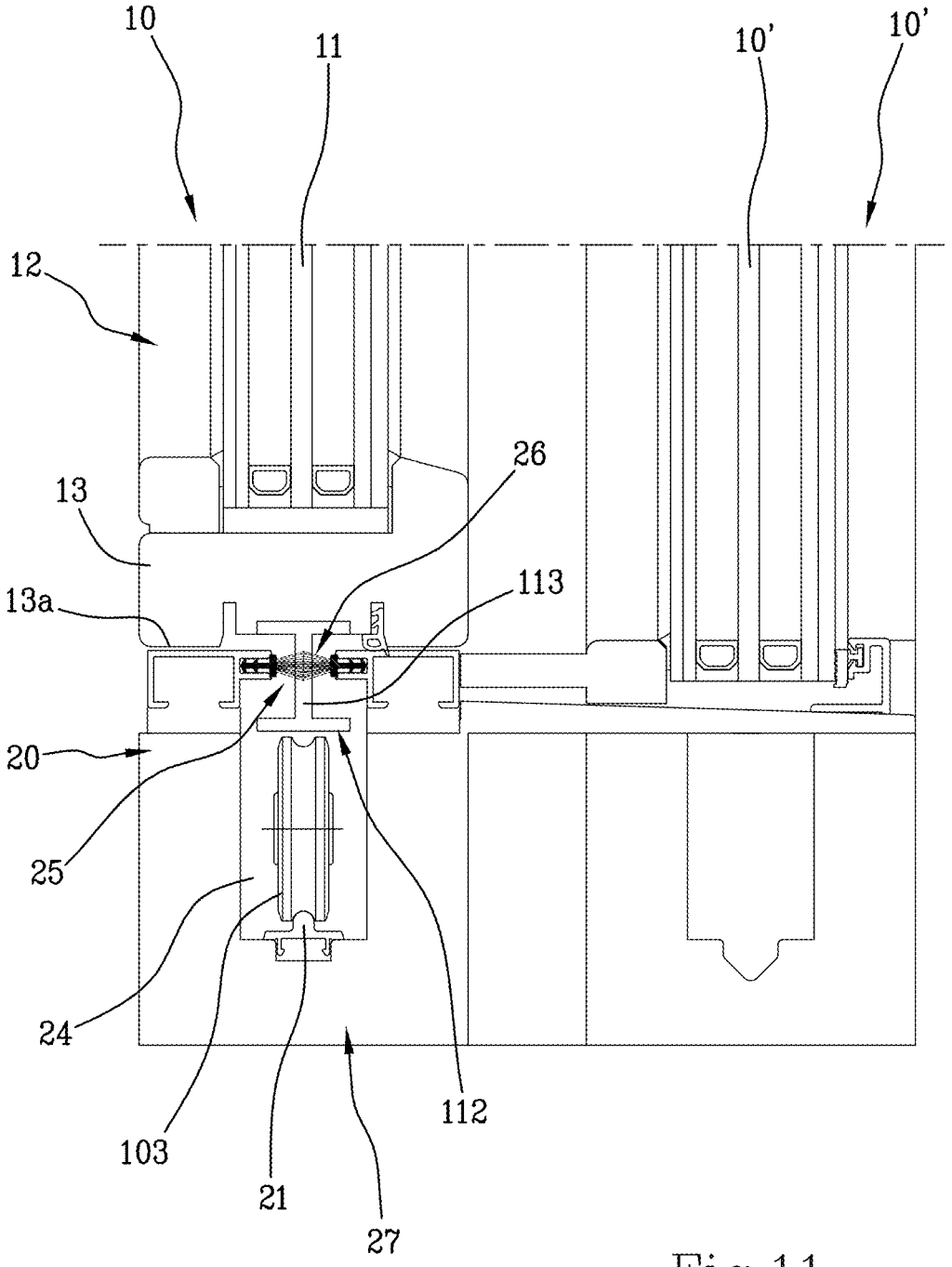

the FIGS. 5 and 6 are respectively longitudinal section views of the sliding window or door of FIG. 1 in two different operating conditions;

FIG. 7 is an enlarged view of a detail of FIG. 1;

FIG. 8 is a schematic view in horizontal section of a multi-sash sliding window or door, in a closed configuration;

FIG. 9 is a schematic view in horizontal section of a multi-sash sliding window or door, in an open configuration;

FIG. 10 is a schematic view in horizontal section of a sliding window or door, in a closed configuration;

FIG. 11 is a schematic view in vertical section of the window or door of FIG. 10.

DETAILED DESCRIPTION OF THE PREFERRED EMBODIMENTS

With reference to the above-mentioned figures, reference number 1 denotes a sliding window or door comprising at least a sash 10 that is slidingly mobile along a substantially horizontal sliding direction "A". The sliding window or door 1 further comprises a frame 20 that can be mounted at a perimeter "P" of an opening of a wall.

In the following part of the present description, the terms "front" and "rear" will be used with reference to the vertical sides of the window or door and/or other aspects of the present invention and in particular the term "front" refers to the vertical side or the part corresponding at which the frame 10 and the door or window 20 are in contact with the closed position of the door or window, while the term "rear" refers to the side or vertical part opposite the contact side between the sash 10 and the door or window 20 in the closed position.

The frame 20 comprises at least a rail 21 illustrated FIG. 11 arranged parallel to the sliding direction "A". According to the illustrated example, the rail 21 is arranged inferiorly of the sash 10. The frame 20 further comprises two vertical uprights arranged respectively at opposite ends of the rail 21. In particular reference numeral 22 denotes a front vertical upright and reference numeral 23 denotes a rear vertical upright.

The sash 10 is slidable between a closed position illustrated in FIG. 1 and FIG. 10, in which the sash is in contact with the front vertical upright 22, and an open position illustrated with reference to a multi-sash window or door (FIG. 9) in which the sash is detached from the front vertical upright 22 and enables access through the opening of the wall.

The frame preferably comprises means for defining a seating 24 illustrated for example FIG. 11. Such seating is wall-mounted with respect to the perimeter of the opening and in particular is arranged below the tread line "C".

The seating 24, as for example illustrated the FIG. 11, has a slot 25 that is parallel to the sliding direction "A". In particular, the seating 24 is superiorly open by means of the slot 25 and internally houses the rail 21.

The slot 25 can be insulated by use of brush elements 26 arranged on opposite sides of the slot with respect to the sliding direction "A" for preventing dust or other extraneous materials from easily invading the seating 24.

The seating 24 and the relative means for defining it, for example profiled or shaped members, in the illustrated embodiment a lower base 27 of the frame 20. The frame 20 further comprises an upper base 28 which completes the perimeter "P" of the opening.

The sash 10 comprises a panel 11 and a border 12 of the panel. The frame 12 comprises a lower base 13 defining a lower base surface 13*a*, an upper base 14 defining an upper base surface, not illustrated, a rear side 15 defining a rear head surface 15*a*, a front side 16 defining a front head surface 16*a*. The rear side 15 preferably and in particular defines the rear head surface 15*a* has a longitudinal groove 17.

In particular, in the closed position of the sash 10, the front head surface 16*a* enters into contact with the front vertical upright 22 of the frame 20. Reference number 100 denotes an actuating device for the sash 10 of the sliding window or door 1 (FIG. 4).

Figure 4:
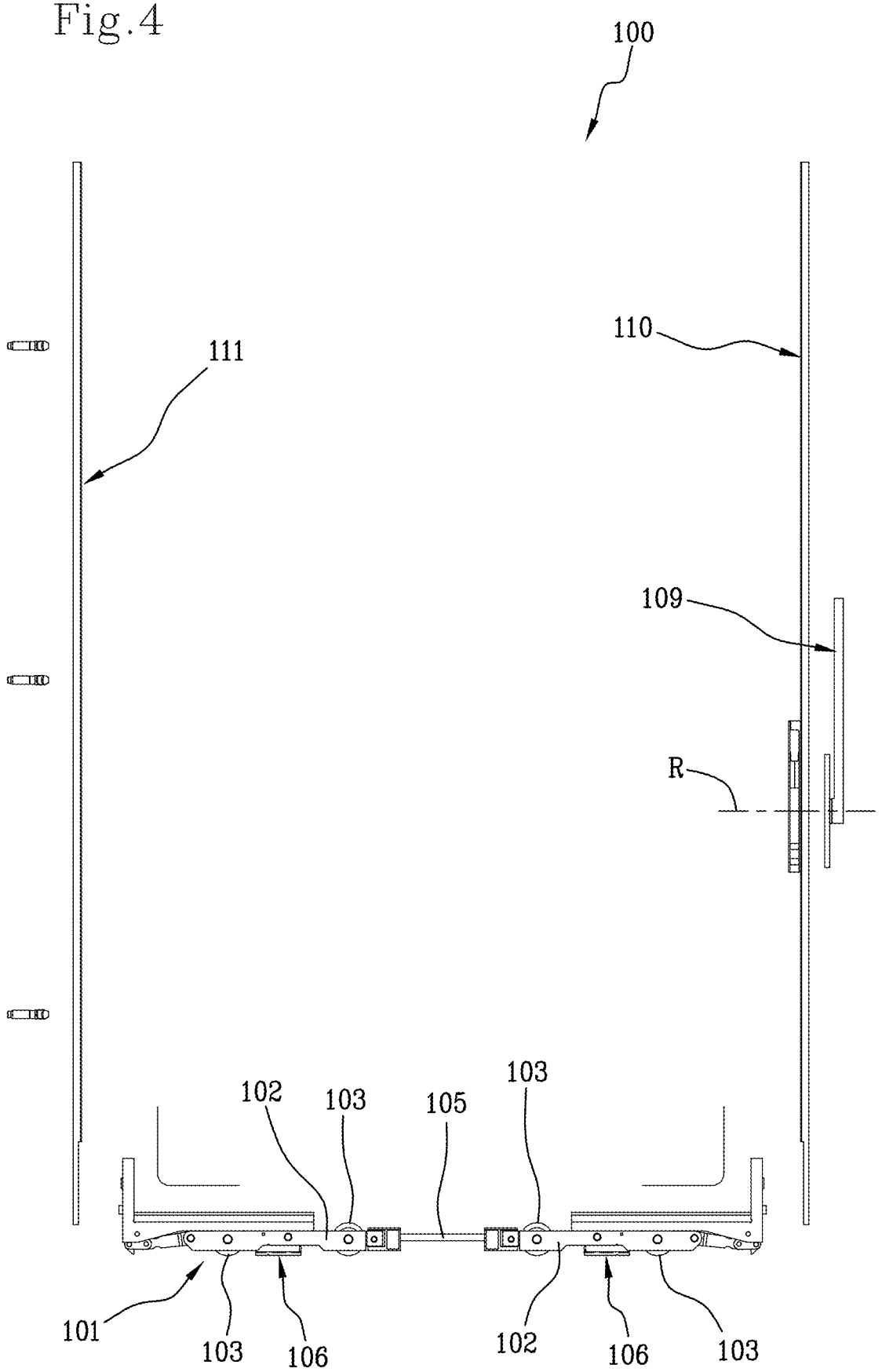
FIG. 4 is a schematic front view of an actuating device according to the present invention, illustrated with the parts separated.

With reference for example to FIG. 4, the actuating device 100 comprises a carriage 101 suitable for being associated to the sash 10 and in particular at the lower base 13 of the sash 10. The carriage 101 comprises at least a slide 102, in the illustrated example two slides 102, provided with rolling means 103 for example in the form of wheels or rollers.

The rolling means are suitable for sliding along the sliding direction "A" on the rail 21.

In particular the slide 102 is mounted on the sash 10 by connecting means configured for enabling a secondary sliding motion "S1" or "S2" of the slide 102 relative to the sash 10 along the sliding direction A between a stationed position, illustrated for example in FIG. 5, and a sliding position, illustrated for example in FIG. 6.

In the stationed position the sash 10 rests on the lower base 27 of the frame 20. In the sliding position the sash 10 is raised with respect to the lower base 27 of the frame 20.

In a possible embodiment, of which the accompanying figures constitute a non-limiting example, the connecting means can comprise at least a connecting rod, preferably a front connecting rod 104*a* and a rear connecting rod 104*b*. Each connecting rod is hinged to the sash 10 and to the slide 102. The front connecting rod 104*a* is preferably hinged at a front vertex of the sash 10 and the rear connecting rod 104*b* is hinged at a rear vertex of the sash 10.

According to a possible embodiment, of which the accompanying figures provide a non-limiting example, the connecting means comprise two slides 102 arranged along the sliding direction A and substantially identical to one another. The two slides are connected for example by an arm 105.

The carriage 101 further comprises at least a connecting portion 106 fixed at a side thereof to the sash 10 and operatively associated at the other side thereof to the slide 102. The connection between the slide 102 and the connecting portion 106 is configured so as to generate the raising and/or the lowering of the sash 10 relative to the lower base 27 of the frame 20 following the secondary sliding motion of the slide 102. In particular the secondary sliding motion "S1" of the slide 102 towards the sliding position of the slide illustrated in FIG. 6 determines the raising of the sash 10 from the lower base 27 so as to enable the sliding along the sliding direction "A". In particular the secondary sliding motion "S2" of the slide 102 towards the stationed position of the slide illustrated in FIG. 5 determines the lowering of the sash 10 which rests on the lower base 27, preventing the sliding along the sliding direction "A".

According to a possible embodiment, of which the accompanying figures constitute a non-limiting example, the connection between the slide 102 and the connecting portion 106 is realised by means of an inclined plane, in particular an inclined slot 107 fashioned in the connecting portion 106 and slidably associated to a cursor 108 associated to the slide 102. In other words, the inclined slot 107 defines means which exploit the above-mentioned concept of "inclined plane" for guiding the movement of a further element, in this case the cursor 108.

The actuating device 100 further comprises a rotating actuating member 109 or handle, advantageously mounted on the rear head surface 15*a* of the sash 10 and in particular the rear side 15 of the frame 12. The rotating actuating member 109 is preferably at least partly housed in the groove 17.

Figure 3:
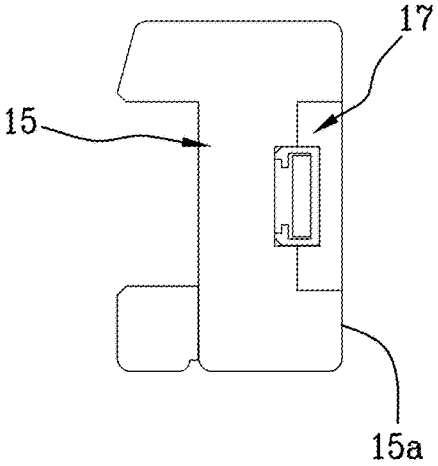
FIG. 3 is a section view according to trace line III-III of a detail of the sliding window or door of FIG. 1.
Figure 2:
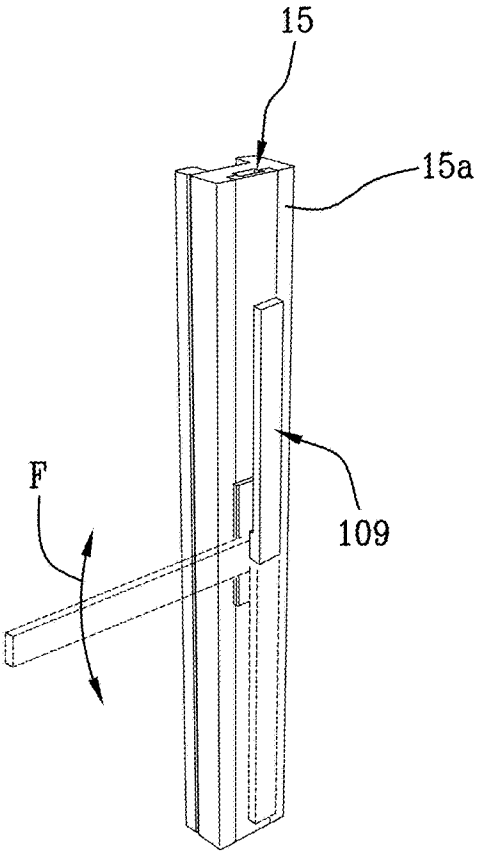
FIG. 2 is a perspective view of a detail of the sliding window or door of FIG. 1.

The rotating actuating member 109 is mounted on the sash 10 with the rotation axis "R" parallel to the sliding direction "A" so that said actuating member can rotate in a plane that is perpendicular to the sliding direction A as, for example, illustrated in FIG. 2 by arrow "F".

The actuating device 100 further comprises a rear command shaft 110 arranged along the rear head surface 15*a* of the sash 10 and in particular in the longitudinal groove 17. The rear command shaft 110 is operatively interposed between the actuating member 109 and the carriage 101 for generating the secondary sliding motion following the rotation "F" of the actuating member 109.

The actuating device 100 further comprises a front command shaft 111 arranged along the front head surface 16*a* of the sash 10. The front command shaft 111 is operatively interposed between the carriage 101 and at least a retaining device (bolt) of the sash 10 for moving the retaining device between a closed position and an open position.

As can be seen in FIGS. 5 and 6, the front connecting rod 104*a* is connected to the front command shaft 111 and the rear connecting rod 104*b* is connected to the rear command shaft 110.

According to a possible embodiment, of which the accompanying figures provide a non-limiting example, the connecting portion 106 of the carriage 101 comprises a profiled element 112 for example illustrated in FIG. 11, suitable for being arranged along a longitudinal extension direction parallel to the sliding direction "A". The profiled element 112 preferably has, in transversal section, at least a plate 113 suitable for being arranged in a vertical direction. In particular the profiled element has a transversal section that is I-shaped, or H-shaped, or T-shaped. The profiled element 112 is preferably arranged in such a way as to cross the slot 25 at the plate 113.

FIG. 10 illustrates the window or door 1 comprising a mobile sash 10 that is mobile along the sliding direction "A" and a fixed sash 10' that is provided with a panel 11', for example made of glass or another transparent material. The opening in the wall extends between the front upright 22 and the rear upright 23. The window or door of FIG. 10 is illustrated in the closed position.

FIG. 8 and FIG. 9 illustrate a multi-sash window or door 1 comprising three sashes 10 mobile along the sliding direction "A", and a fixed sash 10'. The opening in the wall extends between the front upright 22 and the rear upright 23. The window or door of FIG. 8 is illustrated in the closed position, while the door or window of FIG. 9 is illustrated in the open position. Note that the position of the rotating actuating member 109 enables complete packaging of the sashes 10 in the open position and limits the dimension thereof.

In use the sliding window or door 1 arranged in the closed position has the sash 10 resting on the lower base 27 of the frame 20, as for example illustrated in FIG. 5. Following the rotation of the rotating actuating member 109 about the axis "R", the rear command shaft 110 slides downwards and causes the clockwise rotation of the rear connecting rod 104 *b*. Each slide 102 slides along the sliding direction "A", generating the secondary sliding motion "S1" following the action exerted by the rear command shaft 110 and the rear connecting rod 104 *b*. The secondary sliding "S1" of each slide 102 results in clockwise rotation of the front connecting rod 104*a* which in turn pushes the front command shaft 111 upwards, which acts to open the retaining device in a known way. Passing from the configuration of FIG. 5 to the configuration of FIG. 6, the sash 10 is now raised relative to the lower base 27 of the frame. In fact the movement of the actuating device 100 following the rotation of the rotating actuating member 109, denoted in its entirety by arrow "A1" in FIG. 5, advances each slide 102 towards the left with respect to the connecting portion 106 and the cursor 108 slides in the inclined slot 107, causing the raising of the sash 10. At this point the sash 10 can slide along the rail 21 by means of the rolling means 103 up to the desired open position, and vice versa.

Still relating to the closed position of the sash 10, for example following the sliding of the sash along the sliding direction "A" from the open position to the closed position, in the following a description is made of the movement of the actuating device 100 denoted in its entirety by arrow "A2" in order to return the sash into the lowered position starting from the configuration illustrated in FIG. 6. This movement is also generated by the rotation of the rotating actuating member 109 about the rotation axis "R", in an opposite direction to the direction suitable for generating the movement "A1" of the actuating device 100. In this case the rear command shaft 110 is raised. Consequently the rear connecting rod 104*b* rotates in an anticlockwise direction and draws each slide 102 according to the secondary sliding motion "S2". The sliding of the slide 102 cause rotation of the front connecting rod 104*a* in an anticlockwise and a consequent lowering of the front command shaft 111, which acts to close on the retaining device in a known way. In the secondary sliding movement "S2" of each slide 102, the cursor 108 slides in the inclined slot 107, causing the lowering of the sash 10 and return thereof into the illustrated position in FIG. 5.

The present invention enables reducing the section of the frame 12 of the sliding sash 10 to increase the glazed surface, thus maintaining the raising and lowering functions of the sash in order to enable or prevent the opening.

The arrangement of the rotating actuating member 109 on the rear head surface 15*a* enables reducing the dimension of the sash on the main faces thereof. In this way a projection beyond the internal line of the window or door is eliminated, which enables the use of multi-sash windows or doors with total packaging of the sashes and the transport of pre-assembled sashes, i.e. already predisposed with the rotating actuating member 109 in position.

The frame 12, preferably the wood, has a smaller section on all sides including at the rotating actuating member 109. This enables increasing the glazed surface of the whole window or door, thus enabling both the inlet of a greater quantity of opening and an improvement of the thermal performance of the door or window.

The axis "R" of the rotating actuating member 109 preferably coincides with the axis of the rear command shaft 110.

By providing a profiled element that preferably has an "H"-section, it is possible to reduce the transversal dimensions of the slot 25, reducing the aesthetic impact thereof and the risk of contaminations by dust or other external materials.

The carriage is preferably mounted below the level of the threshold, enabling a further increase in the glazed surface of the window or door. Further, the seating 24 can be used in a modular way for simple windows or doors or with a mobile sash or for complex windows or doors with a plurality of mobile and fixed sashes.

The actuating device realised in this way, and the relative sash and window or door, are easily realisable and adaptable to simple or complex windows or doors.

What is claimed is:

1. An actuating device for a sash of a sliding window or door, comprising:

a carriage configured for being associated to said sash, wherein said carriage comprises:

at least one slide provided with a roller configured for sliding along a substantially horizontal sliding direction corresponding to a sliding direction of said sash, a connector configured for mounting said slide on said sash so as to enable a secondary sliding motion of said slide relative to said sash along the sliding direction, between a stationed position and a sliding position and vice versa, at least a connecting portion configured for being fixed to said sash, said connecting portion being operatively associated to said slide by an inclined plane, so that the secondary sliding motion of the slide towards the sliding position determines a raising of the sash and the secondary sliding motion of the slide towards the stationed position determines a lowering of the sash, a rear command shaft configured for being arranged along a rear head surface of said sash and operatively interposed between an actuator and said carriage for generating said secondary sliding motion, a front command shaft configured for being arranged along a front head surface of said sash and operatively interposed between said carriage and at least a retaining device of said sash for moving said retaining device between a closed position and an open position, wherein the actuator comprises a handle configured for being mounted on said rear head surface of said sash having a rotation axis parallel to said sliding direction so that said actuator rotates in a plane that is perpendicular to the sliding direction.

2. The actuating device for a sash of a sliding window or door according to claim 1, wherein said connector comprises a front connecting rod and a rear connecting rod, each connecting rod being configured for being hinged to the sash and to the slide, wherein said front connecting rod is connected to said front command shaft and wherein said rear connecting rod is connected to said rear command shaft.

3. The actuating device for a sash of a sliding window or door according to claim 2, wherein said front connecting rod is configured for being hinged at a front vertex of the sash and wherein said rear connecting rod is configured for being hinged at a rear vertex of said sash.

4. The actuating device for a sash of a sliding window or door according to claim 1, wherein said connecting portion of the carriage comprises a profiled element configured for being arranged with a longitudinal extension direction thereof that is parallel to said sliding direction, wherein said profiled element has, in a transversal section, at least a plate configured for being arranged in a vertical direction.

5. The actuating device for a sliding window or door according to claim 4, wherein said profiled element has the transversal section that is I-shaped, or H-shaped, or T-shaped.

6. The actuating device for a sash of a sliding window or door according claim 1, wherein said carriage comprises two slides configured for being arranged along said sliding direction and connected by an arm, each slide being associated to a connecting portion.

7. A sash for a sliding window or door comprising a panel and a frame of said panel in which said frame comprises a lower base defining a lower base surface an upper base defining an upper base surface, a rear side defining a rear head surface and a front side defining a front head surface, said front head surface being configured for moving into contact with a front vertical upright of a frame of the window or door in a closed position of the sash, said sash further comprising an actuating device according to claim 1 wherein said carriage is mounted on said lower base surface, said front command shaft is arranged along said front head surface, said rear command shaft is arranged along said rear head surface and said handle is mounted on said rear head surface.

8. The sash for a sliding window or door according to claim 7, wherein said rear side has a longitudinal groove configured for at least partly receiving said handle.

9. A sliding window or door comprising a sash according to claim 7 and a frame mountable at a perimeter of an opening of a wall, wherein said frame comprises at least a rail arranged parallel to the sliding direction, and a front vertical upright, wherein said frame comprises a seating that is embedded with respect to the perimeter of the opening and that is configured for receiving said carriage, said seating affording a slot parallel to the sliding direction.

10. The sliding window or door according to claim 9, further comprising a rear vertical upright.

* * * * *